US005586934A

United States Patent [19]

Dombrowski et al.

[11] Patent Number: 5,586,934

[45] Date of Patent: Dec. 24, 1996

[54] WALL SAFE

[76] Inventors: Larry A. Dombrowski, 4281 Cherry Hill Dr., Orchard, Mich. 48323; Daniel S. Goldsmith, 1883 Chipping Way, Bloomfield Hills, Mich. 48302; Judith Goldsmith, 1883 Chipping Way, Bloomfield Hills, Mich. 48302; Walter J. Goldsmith, 1867 Golf Ridge, Bloomfield Hills, Mich. 48302

[21] Appl. No.: 515,141

[22] Filed: Aug. 15, 1995

Related U.S. Application Data

[63] Continuation-in-part of Ser. No. 375,299, Jan. 20, 1995.

[51] Int. Cl.[6] ..... F24F 13/06

[52] U.S. Cl. ..... 454/309; 109/23; 109/47; 109/54; 454/332

[58] Field of Search ..... 109/23, 24, 46, 109/47, 54; 454/284, 309, 322, 330, 332, 333

[56] References Cited

U.S. PATENT DOCUMENTS

| | | | |
|---|---|---|---|
| 1,023,425 | 4/1912 | Harrison | 109/54 |
| 2,754,747 | 7/1956 | Bertling | 454/309 |
| 3,329,278 | 7/1967 | Pachmayr . | |
| 3,752,055 | 8/1973 | Shuler | 454/332 |
| 3,999,493 | 12/1976 | Gulya | 109/23 |
| 4,026,434 | 5/1977 | Howard | 220/18 |
| 4,155,608 | 5/1979 | Orlewicz | 312/204 |
| 4,821,652 | 4/1989 | Hoffman | 109/23 |
| 4,936,038 | 6/1990 | Johnson et al. . | |
| 5,111,755 | 5/1992 | Rouse | 109/47 X |
| 5,176,570 | 1/1993 | Liedl | 454/309 |

OTHER PUBLICATIONS

"Secret Rooms Secret Compartments," Jerry Dzindzeleta, Copyright 1990.

*Primary Examiner*—Harold Joyce
*Attorney, Agent, or Firm*—Gifford, Krass, Groh, Sprinkle, Patmore, Anderson & Citkowski, P.C.

[57] ABSTRACT

A safe is provided for use with a wall having an air duct and an opening to the wall which connects the air duct with a room. The safe includes a housing having an interior dimensioned to fit within the air duct so that the housing is recessed in the wall and in alignment with the wall opening. A grille dimensioned to cover the wall opening is pivotally mounted to the housing so that the grille is movable between a closed position in which the grille overlies and covers the wall opening and an open position in which the opening interior is accessible from the room. A valuable container is mounted within the housing or, alternatively, on the rear side of the grille. Additionally, air passage holes are formed through the housing for enabling air flow through the housing, grille and air duct. Alternatively, the grille is magnetically attached to the housing.

8 Claims, 4 Drawing Sheets

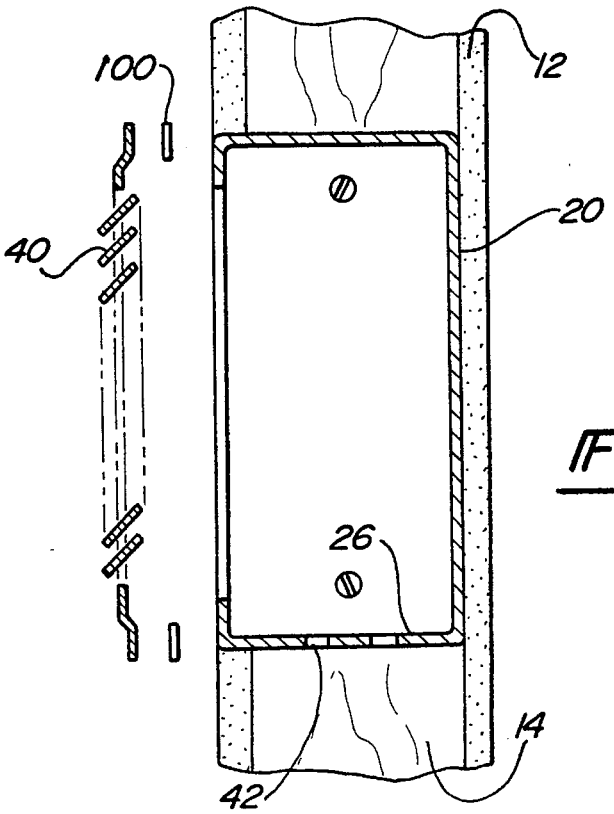
Fig-12
Fig-13
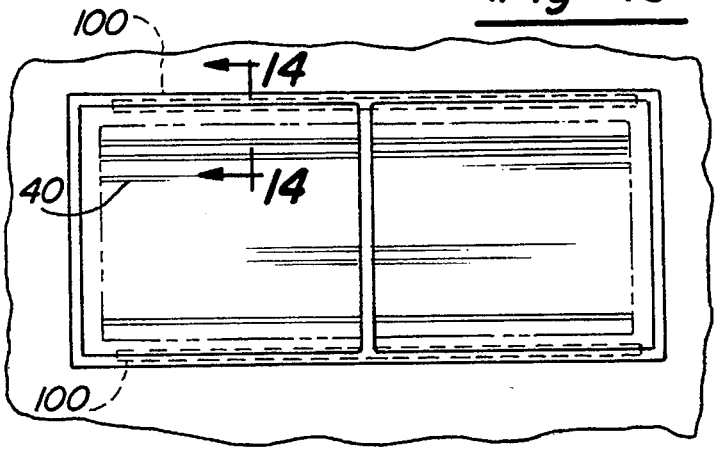
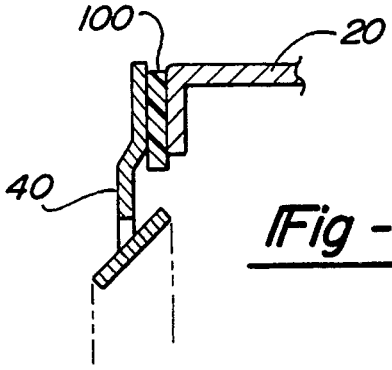
Fig-14

WALL SAFE

CROSS-REFERENCE TO RELATED APPLICATIONS

This application is a continuation-in-part of U.S. patent application Ser. No. 08/375,299, entitled WALL SAFE filed on Jan. 20, 1995.

BACKGROUND OF THE INVENTION

Field of the Invention

The present invention relates generally to wall safes and, more particularly, to a wall safe which is disguised as a return air vent.

There are many previously known wall safes which are designed to be recessed into the interior of a building wall. Such wall safes typically are combination or key operated safes and are frequently hidden behind pictures mounted to the wall. There are, however, two principal disadvantages of these previously known wall safes. First, since such wall safes are commonly hidden behind pictures mounted to the wall, experienced burglars or thieves can rapidly and easily locate the wall safe. Consequently, the hidden aspect of the wall safe provides no real advantage since the safe can be rapidly located.

A still further disadvantage of these previously known wall safes is that either a key or combination is necessary for the owner to open the wall safe. Consequently, the wall safe frequently cannot be rapidly opened or, if the key is inaccessible, it cannot be opened at all. In many situations, however, it would be advantageous to secure a gun or other weapon within the wall safe for protection against intruders. In view of the time necessary to open these previously known wall safes, it is often times impossible to open the safe quick enough to obtain the weapon and repel the intruder.

SUMMARY OF THE PRESENT INVENTION

The present invention provides a wall safe which overcomes all of the above-mentioned disadvantages of the previously known wall safes.

In brief, the wall safe of the present invention is designed for use in conjunction with the wall having an air duct and an opening in the wall which connects the air duct to a room in the building. The safe includes a housing having an interior which is dimensioned to fit within the air duct so that the housing is recessed within the wall and in alignment with the wall opening.

A grille dimensioned to overlie and cover the wall opening is pivotally mounted to the housing so that the grille is movable between an open and closed position. In a closed position, the grille overlies the wall opening and provides the conventional appearance of a cold air return vent. Conversely, in its open position, the grille is moved away from the wall opening and provides access into the interior of the housing.

Preferably, the housing has air openings formed through its bottom so as to permit the flow of air through the grille, housing and air duct so that the air duct operates in its normal fashion.

In one embodiment, the housing includes shelves within the interior of the housing and on which valuables can be stored. In an alternative embodiment of the invention, a valuable container, such as a gun holster, is mounted on the rear side of the grille. Consequently, with the grille in the open position, the holster is accessible from the interior of the room.

In still a further embodiment, the safe includes an internal lift assembly so that the contents of the safe can be selectively stored above or below the grille.

In still a further embodiment, the grille is magnetically detachably secured to the housing.

A prime advantage of the wall safe of the present invention is that, since the wall safe simulates an ordinary cold air return vent, even professional thieves would not be able to locate the wall safe. Furthermore, the contents of the wall safe are rapidly and easily accessible by the person having knowledge of the whereabouts of the safe.

BRIEF DESCRIPTION OF THE DRAWING

A better understanding of the present invention will be had upon reference of the following derailed description when read in conjunction with the accompanying drawing, wherein like reference characters refer to like parts throughout the several views, and in which:

FIG. 12 is an exploded side view illustrating a still further embodiment of the invention;

FIG. 13 is a front view of the embodiment of FIG. 12; and

FIG. 14 is a sectional view taken substantially along line 14—14 in FIG. 13 and enlarged for clarity.

DETAILED DESCRIPTION OF PREFERRED EMBODIMENTS OF THE PRESENT INVENTION

Figure 1:
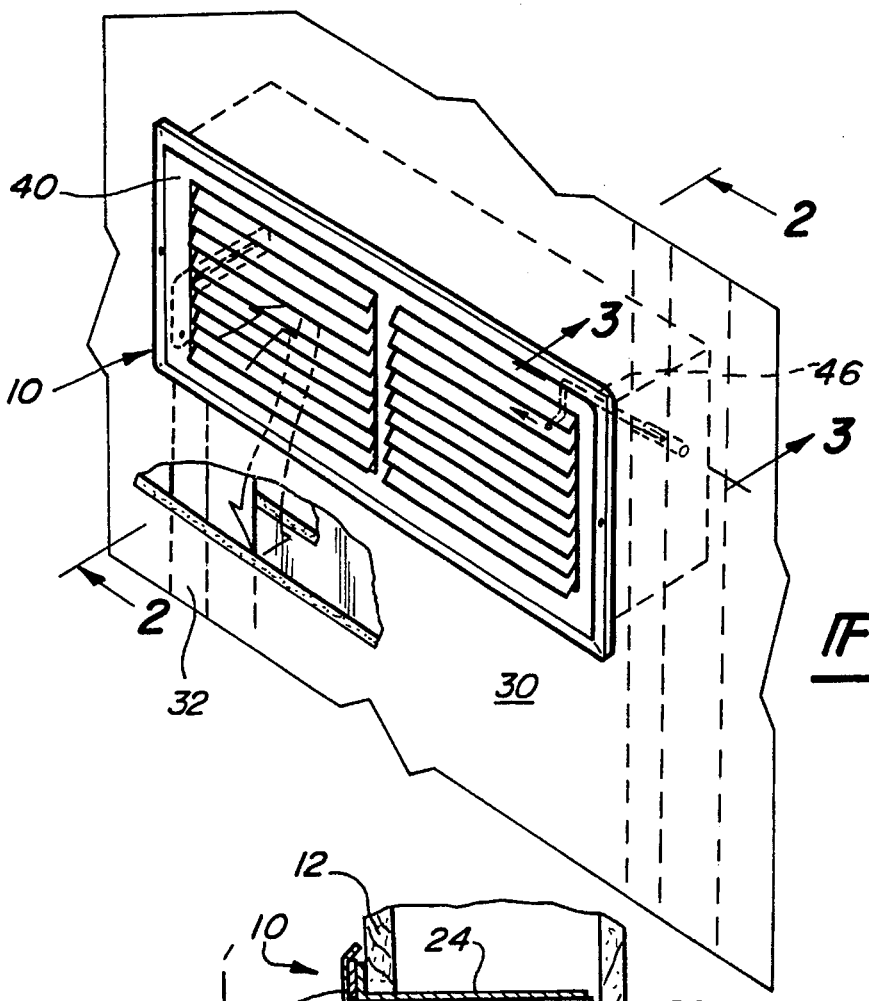
FIG. 1 is a fragmentary elevational view illustrating a preferred embodiment of the present invention.
Figure 2:
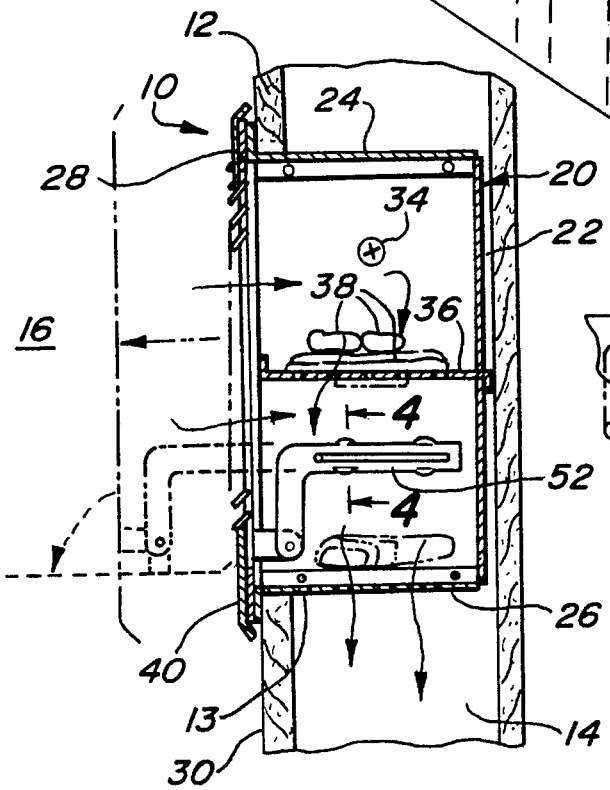
FIG. 2 is a fragmentary sectional view taken substantially along line 2—2 in FIG. 1.

With reference first to FIGS. 1 and 2, a first preferred embodiment of the wall safe 10 of the present invention is thereshown for use with a wall 12 having a cold air return duct 14. An opening 13 in the wall 12 connects the air duct 14 to a room 16 (FIG. 2). Furthermore, such wall 12 with cold air return ducts 14 are commonly found in homes as well as other buildings.

Figure 6:
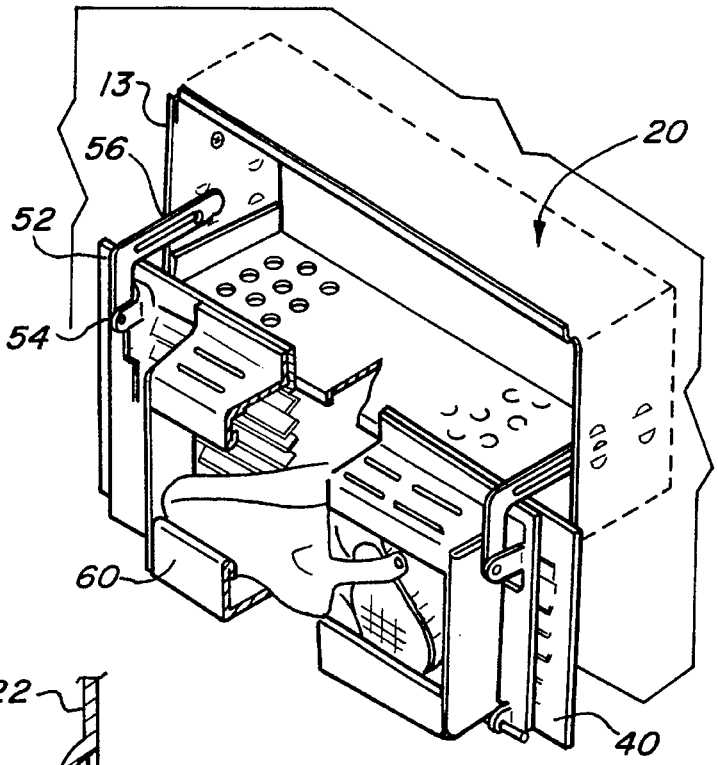
FIG. 6 is a view similar to FIG. 1 but illustrating a further preferred embodiment of the present invention and with the grille in an open position.

Referring now particularly to FIGS. 2 and 6, the wall safe 10 includes a housing 20 having a generally U-shaped back and side wall member 22, a top wall 24 and bottom wall 26. The housing member 22, top wall 24 and bottom wall 26 each preferably comprises a metal stamping and are secured together by any conventional fasteners, such as screws or rivets, to form a generally rectangular housing having an open front 28 (FIG. 2). The open front 28 of the housing 20, furthermore, is generally rectangular in shape and is substantially the same size as the wall opening 12.

As best shown in FIGS. 1 and 2, the housing 20 is mounted within the cold air return duct 14 of the wall 12 so that the housing 20 is recessed within the wall 12 and its open front 28 generally flush with one side 30 of the wall 12. Preferably, the housing 20 is dimensioned to snugly fit in between two studs 32 (FIG. 1) of the wall 12 and is secured to the studs 32 by any appropriate fasteners 34 (FIG. 2).

With reference again to FIGS. 2 and 6, the housing claim thus forms an open interior which is accessible through its front opening 28. A horizontally extending shelf 36 is secured between the sides of the housing 20 so that valuables 38 (FIG. 2) can be stored inside the interior of the housing 20.

Figure 5:
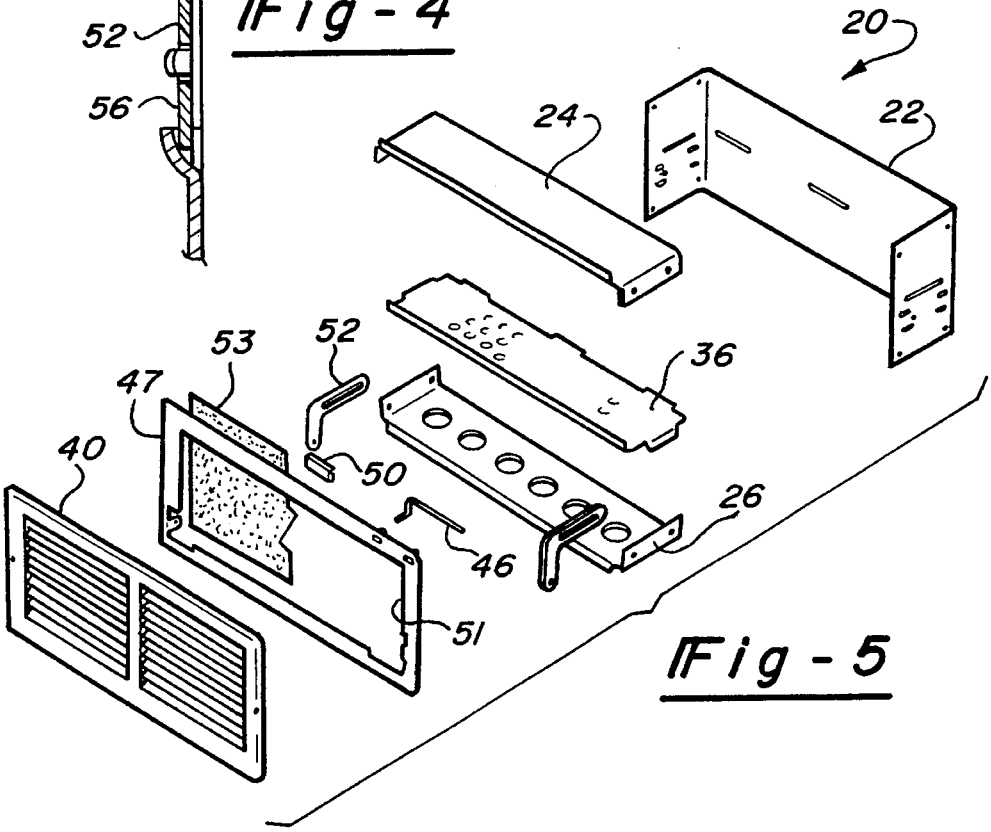
FIG. 5 is an exploded view illustrating a preferred embodiment of the present invention.

With reference now to FIGS. 2 and 5, the wall safe further comprises a generally rectangular grille 40 which is movable between a closed position, illustrated in FIG. 1, and an open position, illustrated in FIG. 5. In its closed position, the rectangular grille 40 overlies and covers the wall opening 13 thus obscuring not only the housing 20, but also any valuables 38 which are contained within the interior of the housing 20. Conversely, with the grille 40 in its open position as shown in FIG. 5, the contents 38 of the interior of the housing 20 are easily accessible from the room 16.

As best shown in FIGS. 2 and 6, the bottom wall 26 of the housing 20 preferably includes a plurality of openings 42 formed through it. These openings 42 allow the free flow of air through the wall air vent 14, housing 20 and grille 40. As such, the cold air return vent 14 operates in its normal fashion while also serving as a wall safe.

Figure 3:
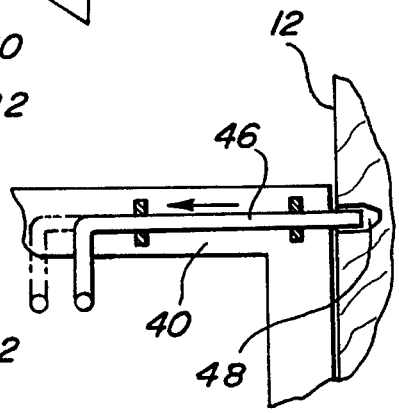
FIG. 3 is a fragmentary sectional view taken substantially along line 3—3 in FIG. 1.

With reference now to FIGS. 1 and 3, in order to secure the grille 40 in its closed position as shown in FIG. 1, and still permit the grille 40 to be rapidly open to its open position (FIG. 5), a locking bar 46 is slidably mounted to the grille 40. The locking bar 46, which is accessible through slats in the grille 40, is movable between its locked position, illustrated in solid line in FIG. 3 and an unlocked position, illustrated in phantom line in FIG. 3. In its locked position, one end of the bar 46 is positioned within a hole 48 formed in the wall 12 thus retaining the grille 40 in its closed position. Conversely, with the bar 46 moved to its unlocked position, the end of the bar 46 is moved out of engagement with the recess 48 thus permitting the grille 40 to be easily moved to its open position.

A magnetic latch 50 (FIG. 6), or any other type of latch, may also alternatively or additionally be positioned between the grille 40 and housing 20 to retain the grille 40 in its closed position.

Figure 7:
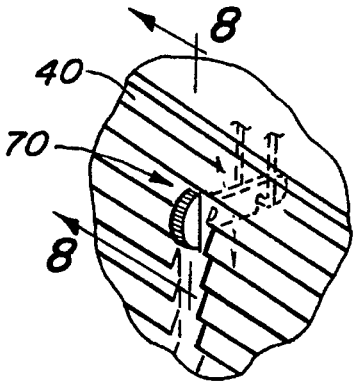
FIG. 7 is a fragmentary elevational view illustrating an alternative locking mechanism for the grille.
Figure 8:
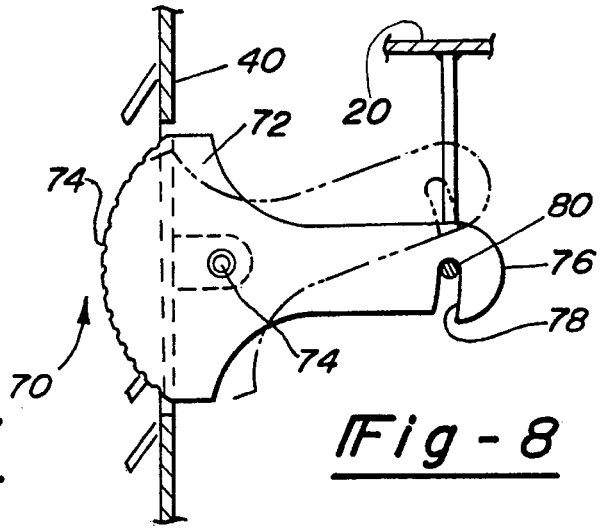
FIG. 8 is a fragmentary sectional view taken substantially along line 8—8 in FIG. 7 and enlarged for clarity.

With reference now to FIGS. 7 and 8, a still further alternate embodiment of a locking means 70 is thereshown for securing the grille 40 in its closed position. The locking means 70 includes a lever 72 pivotally secured to the grille 40 by a pivot pin 74 so that one edge 76 of the lever 72 is accessible exteriorly of the grille 40.

The opposite ends 76 of the lever 72 includes a notch 78 which cooperates with a latch bar 80 secured to the housing 20.

The lever 72 is movable between a locked position, illustrated in solid line in FIG. 8, and an unlocked position, illustrated in phantom line in FIG. 8. In its locked position, the notch 78 engages the bar 80 thereby securing the grille 40 to the housing 20. The lever 72, however, is movable to its open position in which the lever 72 disengages from the bar 80 which enables the grille 40 to be moved to its open position. The outer edge 76 of the lever 72 is employed to move the lever 72 between its locked and unlocked positions.

Referring now to FIGS. 2 and 5, in order to pivotally secure the grille 40 to the housing 20, an L-shaped slide 52 is provided between each side of the housing 20 and opposite sides of the grille 40. One end of the L-shaped slide 52 is pivotally mounted to a rectangular frame 47 by a pivot pin 54. The frame 47 includes a central rectangular opening 51 which registers with the slats or openings in the grille and the frame 47 is secured to the rear side of the grille in any conventional fashion so that the grille 40 and frame 47 move in unison with each other. Thus, the frame 47 and the grille 40 can pivot between its open position (FIG. 6) and closed position (FIG. 1).

Figure 4:
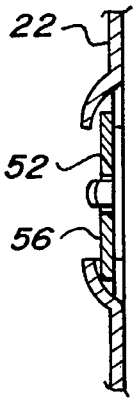
FIG. 4 is a fragmentary sectional view taken substantially along line 4—4 in FIG. 2 and enlarged for clarity.

As best shown in FIGS. 4 and 5, the other leg 56 of the L-shaped slide 52 is longitudinally slidably mounted to the housing member 22 in a direction generally perpendicular to the plane of the wall 12. Consequently, the housing grille is horizontally slidably movable relative to the housing 20 between a retracted position, illustrated in solid line in FIG. 2, and an extended position, illustrated in phantom line in FIG. 2. In its extended position, the grille 40 can freely pivot to its open position without any possible interference with either the wall or the housing 20.

With reference now to FIG. 5, a porous screen 53 may optionally be provided behind the central opening 51 of the frame 47. This porous screen 53 prevents the contents of the safe from being viewed through the openings or slats of the grille 40.

Referring now to FIG. 5, a modification of the present invention is thereshown in which a valuable container 60, such as a gun holster or gun case, is directly mounted to the inside of the grille 40, i.e. the side of the grille facing the interior of the wall 12 when the grille 40 is in its closed position. Thus, when the grille 40 is moved to its open position, the valuable container 60 is freely accessible from the interior of the building room 16.

In the preferred embodiment of the invention, the housing 20 is mounted directly within the cold air return duct of a building wall. This enables the wall safe of the present invention to be easily installed into the wall by simple removal of an existing wall vent in the installation of the housing 20 using the fasteners 34. Furthermore, the original grille 40, which may be a decorative grille in homes, is attached to the frame 47.

Optionally, however, the wall safe 10 may be mounted in any wall by merely cutting an appropriate wall between adjacent studs and mounting the housing within the interior of the wall in the previously described fashion.

Figure 9:
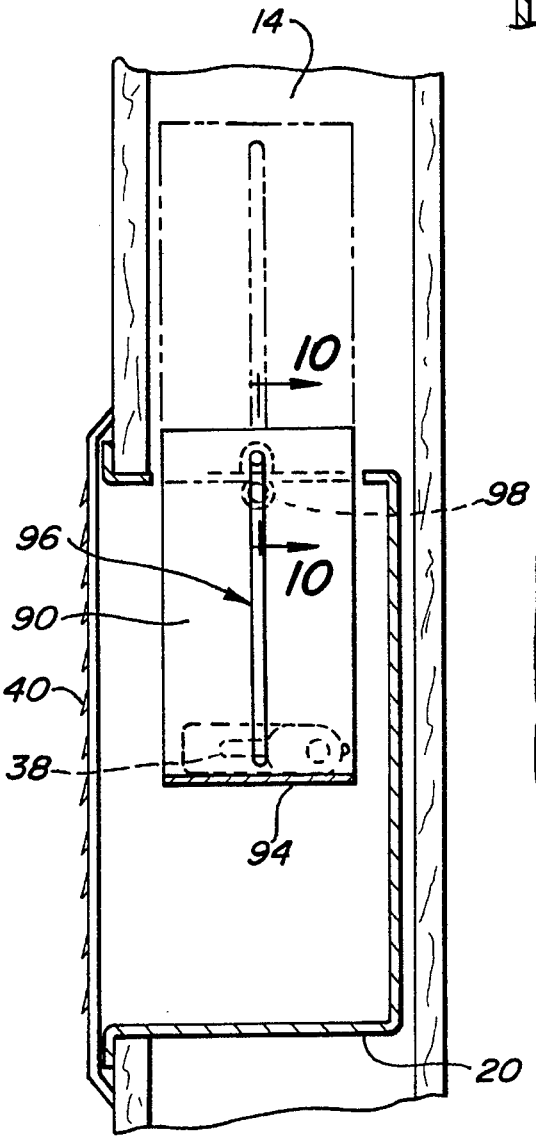
FIG. 9 is a fragmentary side view illustrating still a further embodiment of the present invention.
Figure 10:
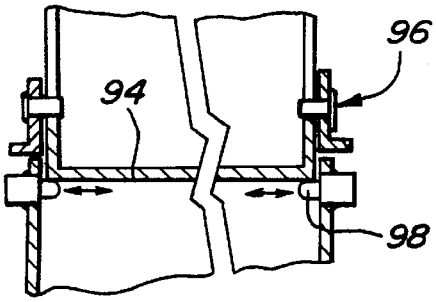
FIG. 10 is a sectional view taken substantially along line 10—10 in FIG. 9.
Figure 11:
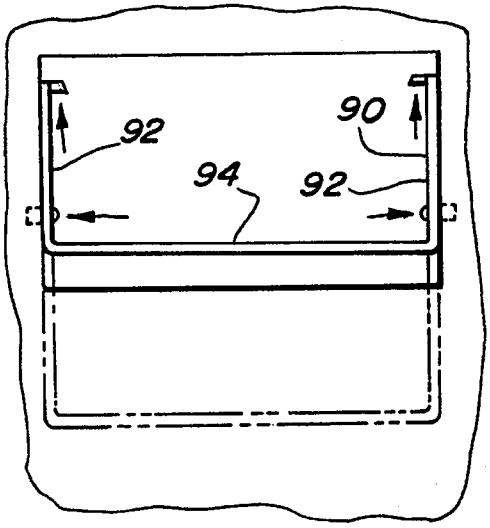
FIG. 11 is a front diagrammatic view illustrating the operation of the FIG. 9 embodiment of the invention.

With reference now to FIGS. 9–11, a still further embodiment of the present invention is thereshown in which an internal lift assembly 90 is contained within the housing 20. As best shown in FIG. 11, the lift assembly 90 is generally U-shaped, having two spaced apart and generally parallel sides 92 and a bottom 94. Valuables 38 (FIG. 9) are positioned on the bottom wall 94 of the lift assembly 90.

The lift assembly 90 is slidably mounted to the housing 20 between a lower position, illustrated in solid line in FIG. 9, and a raised position, illustrated in phantom line in FIG. 9. In its lower position, the lift assembly 90 is positioned within the interior of the housing 20. Conversely, in its raised position, the lift assembly 90, together with the valuables 38, are positioned above the housing 20 in the air duct 14. Consequently, the lift assembly 90 in its raised position, a person viewing the interior of the housing 20 through the openings of the vent 40 would only see the bottom of the lift assembly bottom 94 rather than the valuables 38.

Any conventional slide assembly 96 can be employed to vertically slidably mount the lift assembly 90 to the housing 20. Furthermore, as best shown in FIG. 10, any conventional means, such as spring loaded detents 98, can be employed to retain the lift assembly 90 in its raised position. The detents 98 are manually depressed when lowering of the lift assembly 90, together with the valuables 38 contained in the lift assembly 90, is desired.

Alternatively, the lift assembly 90 can slide downwardly in the air duct to conceal the valuables in the safe.

With reference now to FIGS. 12–14 a still further embodiment of the invention is thereshown in which the housing 20 is mounted in an air duct 14 of the wall 12. Openings 42 are formed through the bottom wall 26 of the housing 20 so that air can flow through the housing 20, if desired.

Unlike the previously described embodiments of the invention, however, a plurality of magnetic strips 100 are secured around the periphery of the metal grille 40 on its rear or wall facing side. These magnetic strips 100 magnetically attach the grille 40 to the housing 20 and conceal the contents of the housing 20. When access to the contents of the safe is desired, the grille 40 is simply removed from the housing 20 by pulling the grille 40 away from the housing 20.

Having described our invention, however, many modifications thereto will be come apparent to those skilled in the art in which it pertains without deviation from the spirit of the invention as defined by the scope of the appended claims.

We claim:

1. For use in conjunction with a wall having an air duct and an opening in the wall which connects a room with the air duct, a safe comprising a housing having a bottom wall and a pair of spaced side walls which together define an interior, said housing dimensioned to fit within the air duct so that said housing is recessed in said wall and in alignment with the wall opening and so that said bottom wall extends transversely across and covers the air duct, a grille dimensioned to overlie and cover the wall opening, means for pivotally mounting said grille to said housing so that said grille is movable between a closed position in which said grille overlies and covers the wall opening and an open position in which said housing interior is accessible from the room, and air passage means formed through one of said walls of said housing for enabling air flow through one of said walls of said housing, said grille and the air duct, wherein said bottom wall of said housing forms a support shelf for items placed in said housing interior.

2. The invention as defined in claim 1 and comprising means for locking said grille in said closed position.

3. The invention as defined in claim 1 wherein said pivotal mounting means further comprises means for slidably movably mounting said grille in a direction substantially perpendicular to the wall.

4. The invention as defined in claim 1 and comprising at least one horizontally extending shelf secured within the interior of said housing.

5. The invention as defined in claim 1 and comprising a container for valuables attached to a side of the grille facing said housing when said grille is in said closed position.

6. For use in conjunction with a wall having an air duct and an opening in the wall which connects a room with the air duct, a safe comprising a housing having a bottom wall and a pair of spaced side walls which together define an interior, said housing dimensioned to fit within the air duct so that said housing is recessed in said wall and in alignment with the wall opening and so that said bottom wall extends transversely across and covers the air duct, a grille dimensioned to overlie and cover the wall opening, means for detachably mounting said grille to said housing so that said grille is movable between a closed position in which said grille overlies and covers the wall opening and an oven position in which said housing interior is accessible from the room, and air passage means formed through one of said walls of said housing for enabling air flow through said housing, said grille and the air duct, wherein said bottom wall of said housing forms a support shelf for items place in said housing interior.

7. The invention as defined in claim 6 wherein said detachable means further comprises magnetic means for mounting said grille to said housing.

8. The invention as defined in claim 7 wherein said magnetic means comprises at least one magnet secured to a wall facing side of said grille at an outer periphery of said grille.

* * * * *